US012359421B1

(12) United States Patent
Alrubaidi et al.

(10) Patent No.: US 12,359,421 B1
(45) Date of Patent: Jul. 15, 2025

(54) MOMENT CONNECTION FOR STEEL FRAMED BUILDINGS

(71) Applicant: KING SAUD UNIVERSITY, Riyadh (SA)

(72) Inventors: Mohammad Alrubaidi, Riyadh (SA); Yousef A. Al-Salloum, Riyadh (SA); Husain Abbas, Riyadh (SA); Hussein M. Elsanadedy, Riyadh (SA); Tarek H. Almusallam, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/979,437

(22) Filed: Dec. 12, 2024

(51) Int. Cl.
*E04B 1/24* (2006.01)

(52) U.S. Cl.
CPC .... *E04B 1/2403* (2013.01); *E04B 2001/2406* (2013.01); *E04B 2001/2415* (2013.01)

(58) Field of Classification Search
CPC ..... E04B 1/2403; E04B 2001/2406; E04B 2001/2415; F16B 2/14; F16B 9/02; F16B 9/05; F16B 9/09; F16B 2200/20; F16B 2200/204; F16B 2200/40; F16B 2200/406; F16B 2200/67
USPC ..... 403/189, 232.1, 233, 234, 263, 272, 381
See application file for complete search history.

(56) References Cited

U.S. PATENT DOCUMENTS 1,662,768 A * 3/1928 Wait ..... E04B 1/2403 403/381
1,786,636 A * 12/1930 Sprunger ..... B25G 3/28 403/248
2,008,087 A * 7/1935 Stromberg ..... F16B 7/00 403/189
3,664,077 A 5/1972 Arnold
3,685,866 A * 8/1972 Patenaude ..... F16B 9/09 403/189
3,901,611 A * 8/1975 Simonsen ..... E04B 1/5812 403/252
3,938,297 A 2/1976 Sato et al.
3,971,179 A * 7/1976 Bodocsi ..... E04B 1/24 52/272

(Continued)

FOREIGN PATENT DOCUMENTS

CN 203878781 U 10/2014
GB 1197458 A 7/1970

*Primary Examiner* — Brian E Glessner
*Assistant Examiner* — Adam G Barlow
(74) *Attorney, Agent, or Firm* — Nath, Goldberg & Meyer; Joshua B. Goldberg

(57) ABSTRACT

An assembly of parts for a structural moment connection includes a first connecting component and a second connecting component. The first connecting component is configured to be connected to a first structural frame member. The second connecting component is configured to be connected to a second structural frame member. The first connecting component includes an elongated protrusion. The second connecting component includes a body having an elongated cavity extending inside of the body from a side surface of the body. The elongated protrusion is configured to be received in the elongated cavity such that the first connecting component and the second connecting component produce a moment connection between the first structural frame member and the second structural frame member when the elongated protrusion is received in the elongated cavity.

15 Claims, 8 Drawing Sheets

(56) References Cited

U.S. PATENT DOCUMENTS

| | | | | | |
|---|---|---|---|---|---|
| 3,977,801 | A * | 8/1976 | Murphy | F16B 7/044 | 248/225.11 |
| 4,019,298 | A * | 4/1977 | Johnson, IV | E04B 1/185 | 403/381 |
| 4,905,436 | A | 3/1990 | Matsuo et al. | | |
| 5,238,321 | A * | 8/1993 | Jarjoura | E04H 12/2215 | 403/178 |
| 5,244,300 | A * | 9/1993 | Perreira | E04B 5/43 | 403/333 |
| 5,688,069 | A * | 11/1997 | Hoshino | E04B 1/215 | 403/339 |
| 5,827,006 | A * | 10/1998 | Hoshino | F16B 7/18 | 403/339 |
| 6,754,992 | B1 * | 6/2004 | Byfield | E04B 1/2403 | 52/36.5 |
| 6,837,016 | B2 * | 1/2005 | Simmons | F16B 9/09 | 403/219 |
| 7,637,076 | B2 | 12/2009 | Vaughn | | |
| 7,883,288 | B2 | 2/2011 | Jorna | | |
| 9,765,521 | B1 | 9/2017 | Abbas et al. | | |
| 9,797,149 | B2 * | 10/2017 | Lavery | E04H 1/1205 | |
| 10,626,594 | B2 | 4/2020 | Yu et al. | | |
| 10,760,261 | B2 | 9/2020 | Richards | | |
| 11,773,593 | B1 * | 10/2023 | Abbas | E04C 3/06 | 52/854 |
| 12,091,879 | B1 * | 9/2024 | Abbas | E04H 9/04 | |
| 2003/0041549 | A1 * | 3/2003 | Simmons | E04B 1/2403 | 52/655.1 |
| 2006/0165482 | A1 * | 7/2006 | Olberding | E04B 1/24 | 403/381 |
| 2013/0055671 | A1 * | 3/2013 | Bruce | E04C 3/08 | 52/645 |

* cited by examiner

MOMENT CONNECTION FOR STEEL FRAMED BUILDINGS

TECHNICAL FIELD

The present disclosure relates to steel framed building connections, and more particularly, to a moment connection for a steel framed building.

DISCUSSION OF THE RELATED ART

Moment connections for steel framed buildings are well-known. A moment connection is a structural connection between a first structural component of a building and a second structural component of the building. The moment connection enables a bending moment to be transmitted between the first and second structural components.

Conventional moment connections require a substantial amount of fabrication time in a steel shop. Steel plates (or other steel shapes) used in beam-beam and beam-column moment connections must first be cut or sheared to size. Bolt holes can be punched through (that is, sheared) or drilled in each plate for each bolt that will be used in the moment connection. A large number of bolts is typically required on each side of the moment connection. Matching holes are typically drilled in the corresponding structural components (e.g., beams or columns) that will be connected to one another via the plates. This fabrication process is costly.

In addition, the structural components must then be connected to one another at the steel erection site. The structural components must be lined up with one another in their intended arrangement, the plates must be positioned at their designated area of the moment connection, and the bolts must be fed through the plates and through the structural components being connected. The nuts are then connected to the bolts and tightened to specification.

In addition, moment connections typically require a significant amount of welding of the plates (or other steel shapes) to the beams and/or columns at the steel erection site.

The process of bolting and welding structural components to one another in the field is costly and time consuming. These costs typically increase when the construction crew faces adverse working conditions, such as being exposed the elements of weather and height.

SUMMARY

The present disclosure relates to a pair of connecting components that can be selectively connected to one another to form a moment connection between a beam and a column, or between two beams, when the beam(s) and/or column are respectively connected to the connecting components.

The first connecting component includes a T-shaped elongated protrusion that is tapered in its length direction. The second connecting component includes a matching T-shaped elongated cavity that is tapered in its length direction. The tapering of the elongated protrusion and the tapering of the elongated cavity allows a one-way entry of the elongated protrusion in the elongated cavity. In addition, the tapering of the elongated protrusion and the tapering of the elongated cavity prevents the elongated protrusion from exiting through the narrow end of the elongated cavity once the elongated protrusion is seated in the elongated cavity. This configuration achieves a strong moment connection between the first and second connecting components.

The first and second connecting components can be produced at a low cost in a steel fabrication shop. The first and second connecting components simplify the process of connecting the beams and columns to one another in the field by significantly reducing the amount of welding and bolting that must be performed in the filed to connect the beams and the columns to one another. This configuration significantly reduces the time and cost of erecting a steel framed building.

BRIEF DESCRIPTION OF THE DRAWINGS

The above and other features of the present disclosure will become more apparent by describing in detail exemplary embodiments thereof in conjunction with the accompanying drawings, in which.

DETAILED DESCRIPTION OF THE EMBODIMENTS

Figure 1:
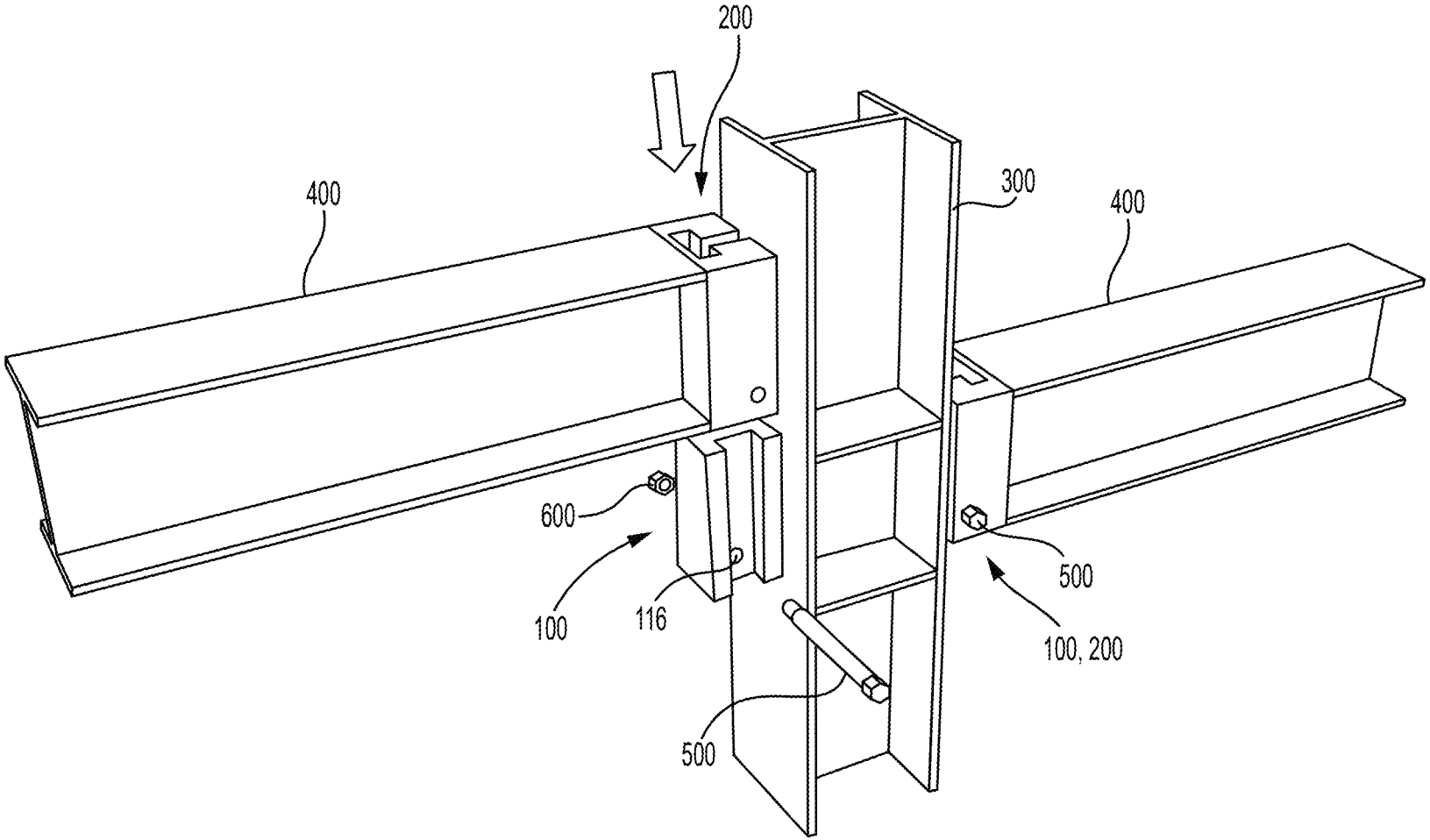
FIG. 1 is a perspective view illustrating a frame of a building, said frame including an assembly of parts for a structural moment connection according to an exemplary embodiment of the present disclosure.

Exemplary embodiments of the present disclosure will be described more fully hereinafter with reference to the accompanying drawings. The present disclosure may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" may include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, dimension ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

An assembly of parts for a structural moment connection according to an exemplary embodiment of the present disclosure will be described with reference to FIGS. 1-6.

Referring to FIG. 1, an assembly of parts for a structural moment connection includes a first connecting component 100 and a second connecting component 200.

The first connecting component 100 is configured to be connected to a first structural frame member 300 (e.g., a metallic column of a building's frame). The second connecting component 200 is configured to be connected to a second structural frame member 400 (e.g., a metallic beam of the building's frame). FIG. 1 illustrates the first connecting component 100 connected to the first structural frame member 300, and the second connecting component 200 connected to the second structural frame member 400.

Figure 6:
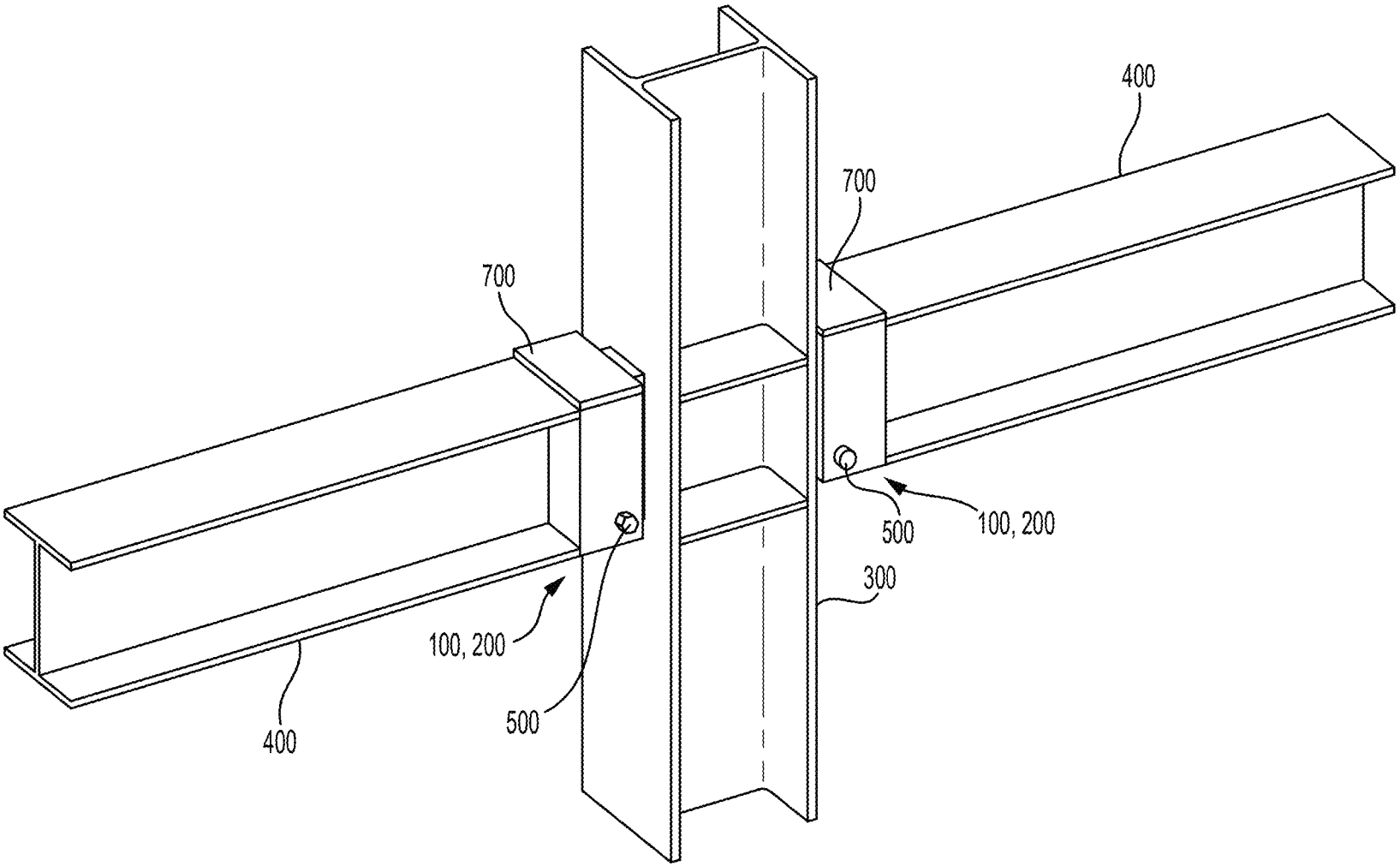
FIG. 6 is a perspective view illustrating the frame of the building of FIG. 1 with a metal plate connected to the assembly of parts that includes the first and second connecting components.

FIGS. 1 and 6 illustrate a pair of assemblies of parts of the present disclosure (each assembly including first and second structural connecting components 100, 200) to exemplarily illustrate that a metallic building frame can be built with a plurality of assemblies of parts as disclosed in this specification. The assemblies of parts illustrated in FIGS. 1 and 6 may be identical to one another. Therefore, the disclosure below will describe in detail one of the assemblies of parts that contains a first and a second connecting component 100, 200. Said assembly of parts may be referred to as "the" assembly of parts for convenience of description.

Each one of the first and second connecting components 100, 200 may be made of a metal. The metal may be steel. The steel may be carbon steel, for example, structural grade carbon steel, which is the most commonly used material for constructing metallic building frames, or stainless steel, which is sometimes used in miscellaneous steel applications.

However, the first and second connecting components 100, 200 may also be made of other metals, for example, aluminum, brass, nickel, zinc, etc., or alloys thereof.

The first and second structural frame members 300, 400 may be made of the same material (e.g., the same metal or metal alloy) as the first and second connecting components 100, 200, or may be made of a different material (metal or otherwise).

Figure 2B:
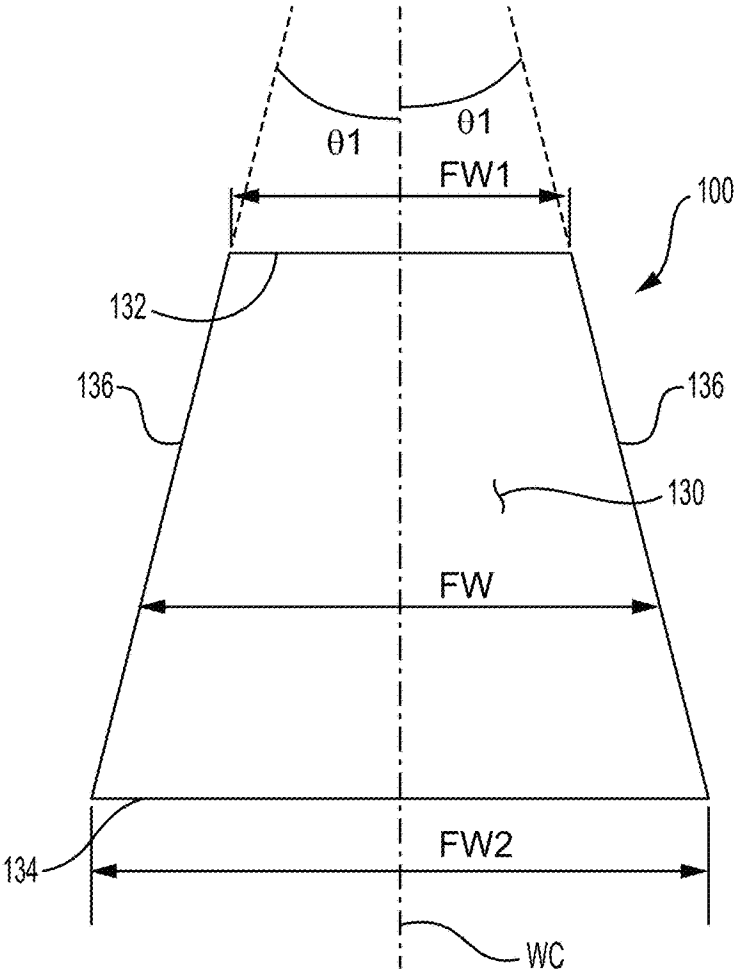
FIG. 2B is a side view illustrating the first connecting component of FIG. 2A.
Figure 2A:
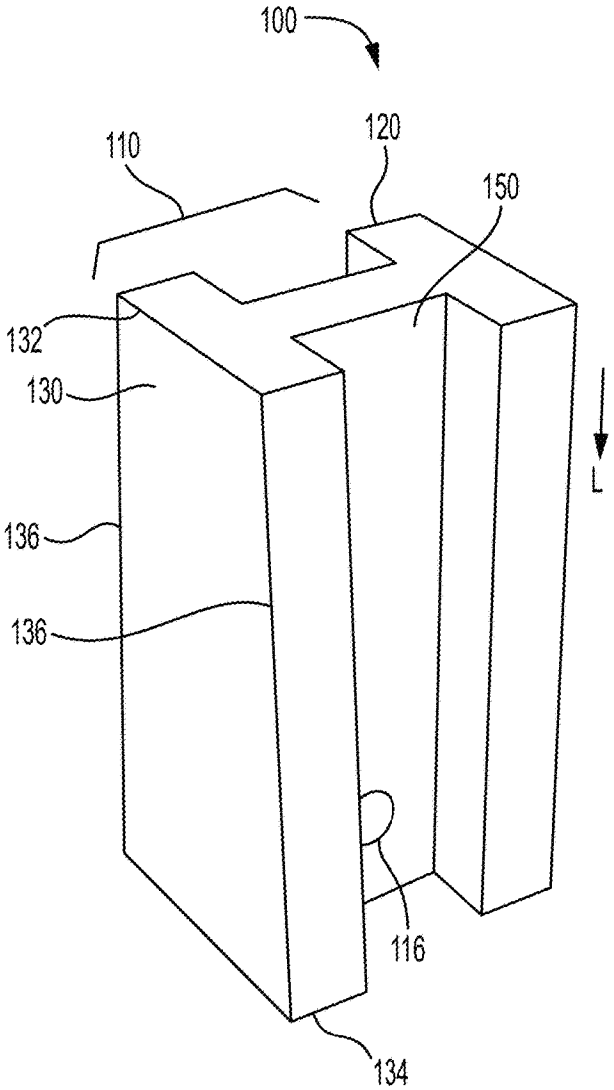
FIG. 2A is a perspective view illustrating a first connecting component of the assembly of parts of FIG. 1.

Referring to FIGS. 2A-2B, the first connecting component 100 may include a base 120 and an elongated protrusion 110. The elongated protrusion 110 protrudes from the base 120.

The base 120 is configured to be connected to the first structural frame member 300 by welding and/or bolting.

Figure 3B:
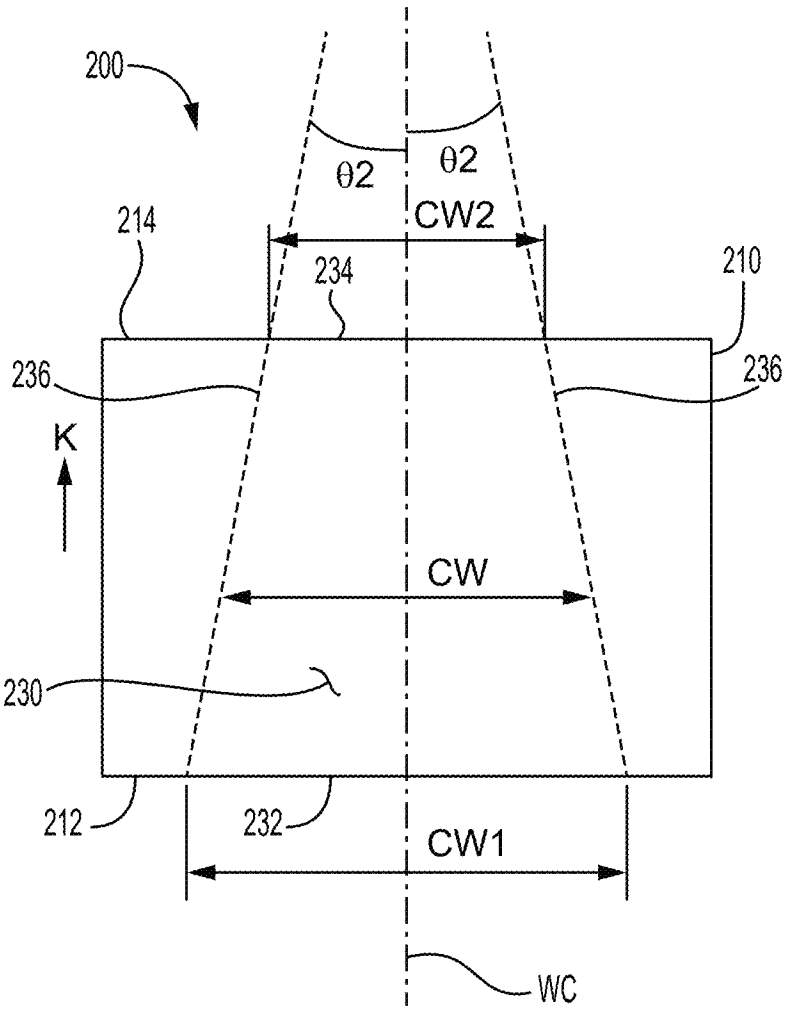
FIG. 3B is a side view illustrating the second connecting component of FIG. 3A.
Figure 3A:
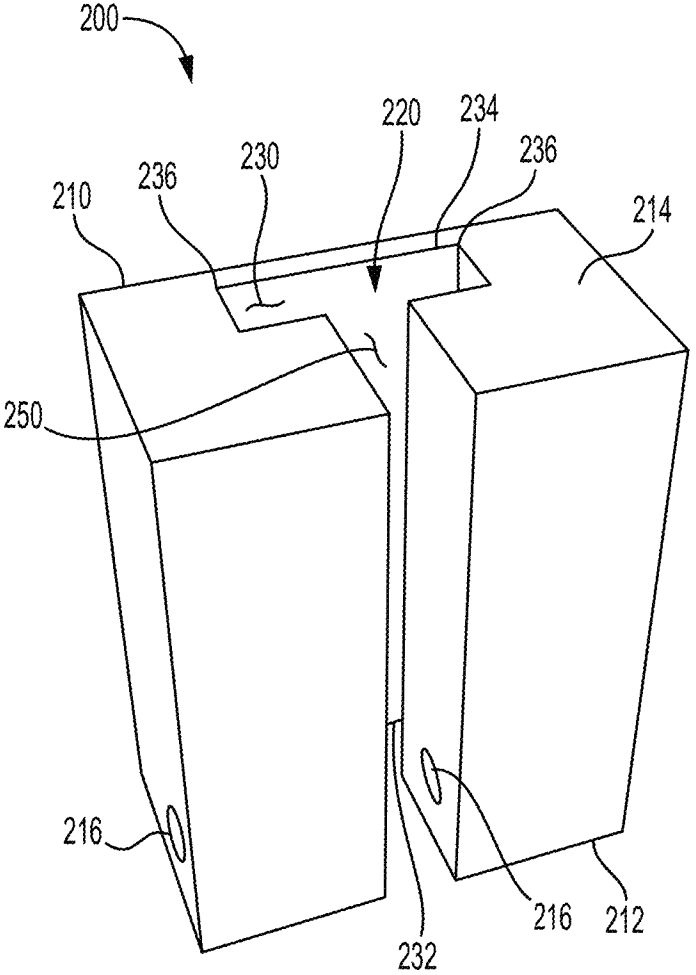
FIG. 3A is a perspective view illustrating a second connecting component of the assembly of parts of FIG. 1.

Referring to FIGS. 3A-3B, the second connecting component 200 includes a body 210. The body 210 has an elongated cavity 220 extending inside of it from a side surface 212 of the body 210. As illustrated in FIG. 3A, the elongated cavity 220 may extend throughout the entire length of the body 210 such that it is exposed from (or daylights in) an opposite side surface 214 of the body 210. However, the elongated cavity 220 need not extend the entire length of the body 210. In the less than full length approach, the side surface 214 of the body 210 may be closed (or solid) since the elongated cavity 220 does not daylight from it.

The elongated protrusion 110 is configured to be received in the elongated cavity 220 such that the first connecting component 100 and the second connecting component 200 produce a moment connection between the first structural frame member 300 and the second structural frame member 400 when the elongated protrusion 110 is received in the elongated cavity 220 (when the first connecting component 100 is connected to the first structural frame member 300 and the second connecting component 200 is connected to the second structural frame member 400).

Referring to FIGS. 2A-2B, the elongated protrusion 110 includes a flange 130 and a web 150 connected to one another, the flange 130 and the web 150 extending in a length direction L of the elongated protrusion 110. The flange 130 and the web 150 may form a T-shaped elongated protrusion, as illustrated in FIG. 2A.

Referring to FIGS. 3A-3B, the elongated cavity 220 includes a first cavity portion 230 and a second cavity portion 250. The first and second cavity portions 250, 230 are in fluid communication with one another, and extend in a length direction K of the body 210 of the second connecting component 200. The first and second cavity portions 250, 230 may form a T-shaped cavity that extends in the length direction K, as illustrated in FIG. 3A.

The flange 130 of the elongated protrusion 110 is configured to be received in the first cavity portion 230, and the web 150 of the elongated protrusion is configured to be received in the second cavity portion 250.

Referring to FIGS. 2A-2B, the flange 130 of the elongated protrusion 110 has a first end 132, a second end 134, and a flange length extending in the length direction L of the elongated protrusion. The flange length of the flange 130 is delimited by the first and second ends 132, 134. The first end 132 of the flange 130 is configured to enter the first cavity portion 220 first. Stated otherwise, the first end 132 is configured to enter the first cavity portion 220 before the second end 134.

Referring to FIGS. 3A-3B, the first cavity portion 230 has a first end 232, a second end 234, and a first cavity length extending in the length direction K of the body 210 of the second connecting component 200. The first cavity length is delimited by the first and second ends 232, 234 of the first cavity portion 230. The first end 232 of the first cavity portion 230 is configured to provide access to the first cavity portion 230 such that the flange 130 of the elongated protrusion 110 can be moved inside of the first cavity portion 230, through the first end 232 of the first cavity portion 230, with the first end 132 of the flange 130 entering the first end 232 of the first cavity portion 230 first.

As illustrated in FIG. 2B, the flange 130 of the elongated protrusion 110 has a first flange width FW1 proximate to the first end 132, and a second flange width FW2 proximate to the second end 134. The first flange width FW1 is smaller than the second flange width FW2.

As illustrated in FIG. 2B, a width FW of the flange 130 of the elongated protrusion 110 increases along the flange length in a direction toward the second end 134 of the flange 130. For example, and as can be gleaned with reference to FIGS. 2A-2B, the width FW of the flange 130 can vary linearly along the flange length, between the first flange width FW1 and the second flange width FW2. Therefore, the flange 130 of the elongated protrusion 110 has a variable width FW along the length direction L of the elongated protrusion 110.

Stated otherwise, the width FW of the flange 130 may be tapered along the length of the flange 130. The tapering causes the width FW of the flange 130 to increase in a direction toward the second end 134 of the flange 130.

Referring to FIG. 2B, and due to the tapering, a peripheral edge 136 of the flange 130 tapers with an angle Θ1 that ranges from about 2 degrees to about 5 degrees relative to a width centerline WC of the flange 130. The width centerline WC extends along the flange length K.

Referring to FIG. 3B, the first cavity portion 230 has a first width CW1 proximate to the first end 232, and a second width CW2 proximate to the second end 234. The first width CW1 of the first cavity portion 230 is greater than the second width CW2 of the first cavity portion 230.

Referring to FIG. 3B, a width CW of the first cavity portion 230 decreases along the first cavity length in a direction toward the second end 234 of the first cavity portion 230. The width CW can be varied linearly along the first cavity length, between the first width CW1 of the first cavity portion 230 and the second width CW2 of the first cavity portion 230.

Stated otherwise, the first cavity portion 230 may have a variable width CW along the length direction K of the body 210 of the second connecting component 200.

The variable width FW of the flange 130 of the elongated protrusion 100 should match the variable width CW of the first cavity portion 230.

Therefore, and with reference to FIG. 3B, a peripheral edge 236 of the first cavity portion 230 tapers with an angle Θ2 ranging from about 2 degrees to about 5 degrees relative to the width centerline WC of the first cavity portion 230, the width centerline WC of the first cavity portion 230 extending along the first cavity length. In other words, the angle Θ2 may have the same range as the angle Θ1.

This configuration ensures not only that the flange 130 fits in the first cavity portion 230, but also provides a high surface-to-surface contact area between the flange 130 and the portion of the body 210 that comes in contact with the flange 130 around the first cavity portion 230.

The high surface-to-surface contact area distributes the reaction force at the contact area between the flange 130 and the body 210, due to the dead and/or live loads applied to the first and/or second structural frame members 300, 400, over a large area (when the first and second structural frame members 300, 400 are connected to the first and second connecting components 100, 200, and the first and second connecting components 100, 200 are connected to one another).

Since stress equals force over area, the distribution of force over a large surface area at the interface between the flange 130 and the body 210 reduces the stress at the interface (or contact area) between the flange 130 and the body 210. The reduction of stress increases the strength of the moment connection achieved by using the first and second connecting components 100, 200 by virtue of reducing the likelihood of failure of the first and/or second connecting component 100, 200 due to concentrated stress.

Figure 4:
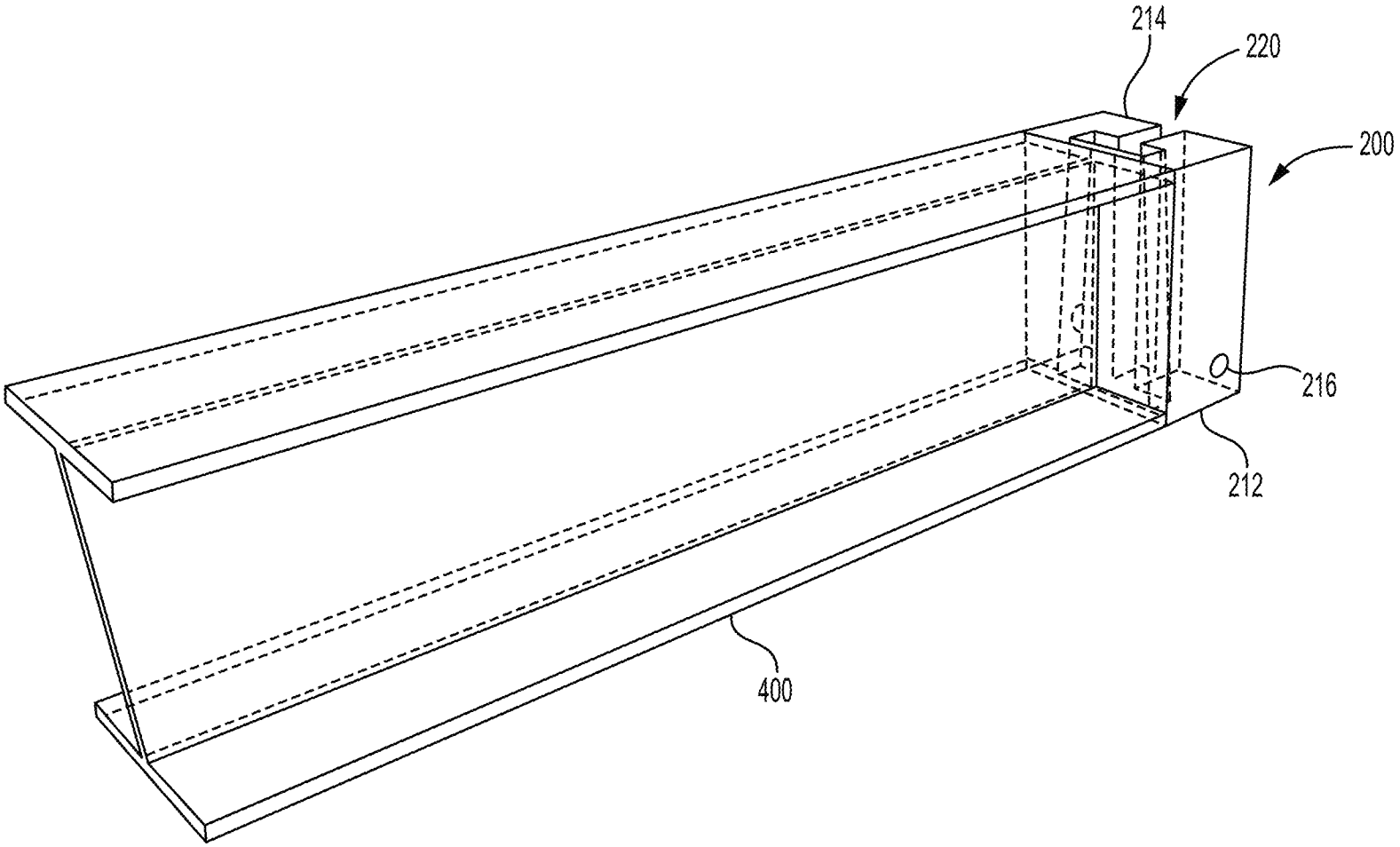
FIG. 4 is a perspective view illustrating the second connecting component connected to a beam of the frame illustrated in FIG. 1.
Figure 5:
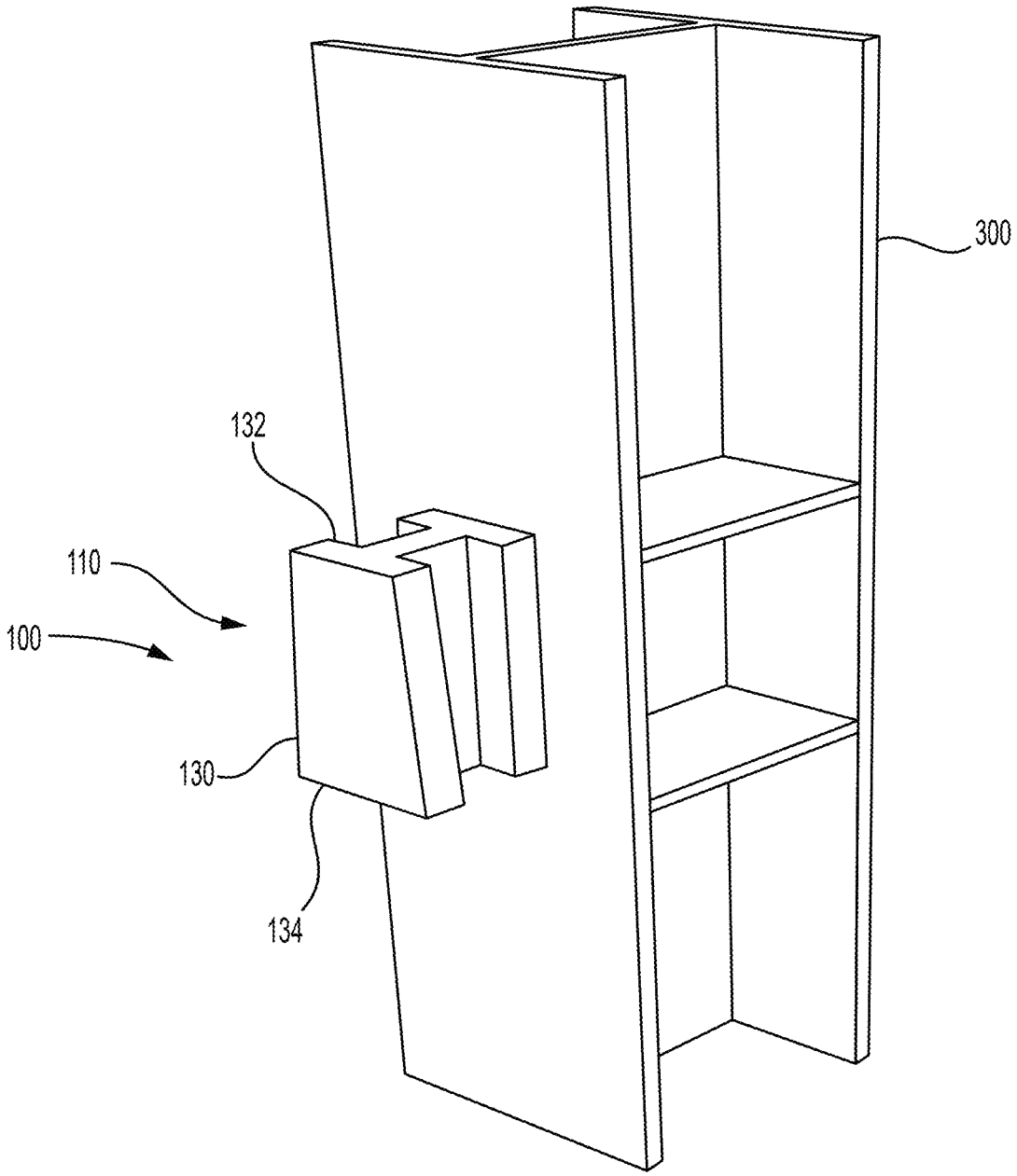
FIG. 5 is a perspective view illustrating the first connecting component connected to a column of the frame illustrated in FIG. 1.

When the first connecting component 100 is connected to a column 300 and the second connecting component 200 is connected to a beam 400, as illustrated in FIGS. 1, 4 and 5, the first connecting component 100 is oriented with the first end 132 of the flange 130 arranged above the second end 134 of the flange 130, as illustrated in FIG. 5, and the second connecting component 200 is oriented with the first end 232 of the first cavity portion 230 arranged below the second end 234 of the first cavity portion 230. This configuration enables the first and second connecting components 100, 200 to be selectively connecting to one another by positioning the second connecting component 200 above the first connecting component 100, and moving the second component downwardly to selectively insert the elongated protrusion 110 in the elongated cavity 220.

Once connected, the shape of the elongated protrusion 110 and the shape of the elongated cavity 220, as described in this specification, prevents further downwardly movement of the second connecting component 200 (due to the tapering of the flange 130 and the tapering of the first cavity portion 230). Thereby, a moment connection is achieved between the first and second connecting components 100, 200.

Referring to FIGS. 1 and 2A, the elongated protrusion 110 includes a first through hole 116 extending in the web 150 thereof in a direction that crosses the length direction L of the elongated protrusion 110. Referring to FIGS. 3A and 4, the body 210 of the second connecting component 200 includes a second through hole 216. The second through hole 216 extends in a direction that crosses the length direction K of the body 210. The second through hole 216 may cross the second cavity portion 250.

The first and second through holes 116, 216 are configured to line up with one another when the elongated protrusion 110 is received in the elongated cavity 220 such that a bolt 500 can be selectively extended therethrough to prevent the first and second connecting components 100, 200 from being disconnected from one another. As illustrated in FIG. 1, a nut 600 can be connected to the bolt 500 to secure the bolt 500 in place. The securement of the bolt 500 to the first and second connecting components 100, 200 prevents the first and second connecting components 100, 200 from being moved in the vertical direction relative to one another (i.e., prevents the first and second connecting components 100, 200 from being separated from one another).

FIG. 3B does not illustrate the second cavity portion 250 and the first through hole 216 to avoid cluttering the drawing. The second cavity portion 250 may have a uniform width and a uniform thickness in the length direction K of the body 210 of the second connecting component 200.

As illustrated in FIG. 6, the assembly of parts for a structural moment connection may also include a metal plate 700. The metal plate 700 can be welded to the first and second connecting components 100, 200 to further increase the strength of the moment connection formed by the first and second connecting components 100, 200. The metal plate 700 can be welded, for example, to the top surfaces of the first and second connecting components 100, 200 when the first and second connecting components 100, 200 and connected to one another.

The first connecting component 100 can be produced, for example, by casting metal (e.g., steel) into a mold defining the shape and size of the first connecting component, by obtaining a standard I-beam (such as a W-shape, an S-shape, etc.) and modifying the flange and/or web of the beam by grinding, milling and/or welding, or by manufacturing the flange(s) and/or web of the first connecting component to individually and welding them to one another.

The second connecting component 200 can be produced, for example, by casting metal in a mold defining the shape and size of the second connecting component, by starting with a block of metal (e.g., steel) and milling/grinding the first and second cavity portions, or by manufacturing the second connecting component in parts and welding the parts to one another.

In the embodiment of FIGS. 1-6, the web 150 has a uniform thickness and a uniform width along the length direction L of the elongated protrusion 110. In this embodiment, the second cavity portion 250 has a uniform thickness and a uniform width along the length direction L of the elongated protrusion 110.

However, the present subject matter is not limited to this configuration. As indicated elsewhere in this specification, the thickness of a web of an elongated protrusion may be varied along the length the web, and the thickness of a second cavity portion configured to receive the web therein may be varied along the length of the second cavity portion to accommodate the web therein. In addition, or alternatively, the thickness of a flange of an elongated protrusion may be varied along the length of the flange, and the thickness of a first cavity portion configured to receive the flange therein may be varied along the length of the first cavity portion to accommodate the flange therein. Moreover, or alternatively, the width of a flange of an elongated protrusion may be varied along the length of the flange, and the width of a first cavity portion configured to receive the flange therein may be varied along the length of the first cavity portion to accommodate the flange therein.

For example, the embodiment of FIGS. 7A-7D and 8A-8C includes a taper in the thickness of the flange, a taper in the width of the flange, and a taper in the thickness of the web of the first elongated protrusion of the first connecting component. The second connecting component of the embodiment of FIGS. 7A-8C includes a taper in the first cavity portion and a taper in the second cavity portion to accommodate the tapering flange and web therein.

The tapering of the flange width of the assembly of components of FIGS. 7A-8C may be the same as the tapering of the flange width of the assembly of components of FIGS. 1-6. Therefore, a detailed description of the flange width of the assembly of components of FIGS. 7A-8C may be omitted for brevity purposes. All aspects/features of the embodiment of FIGS. 7A-8C not described in detail may be assumed to be the same as or similar to corresponding aspects/features described with reference to the embodiment of FIGS. 1-6.

Referring to FIGS. 7A-8C, an assembly of parts for a structural moment connection includes a first connecting component 100A and a second connecting component 200A.

Figures 7A, 7B, 7C, 7D:
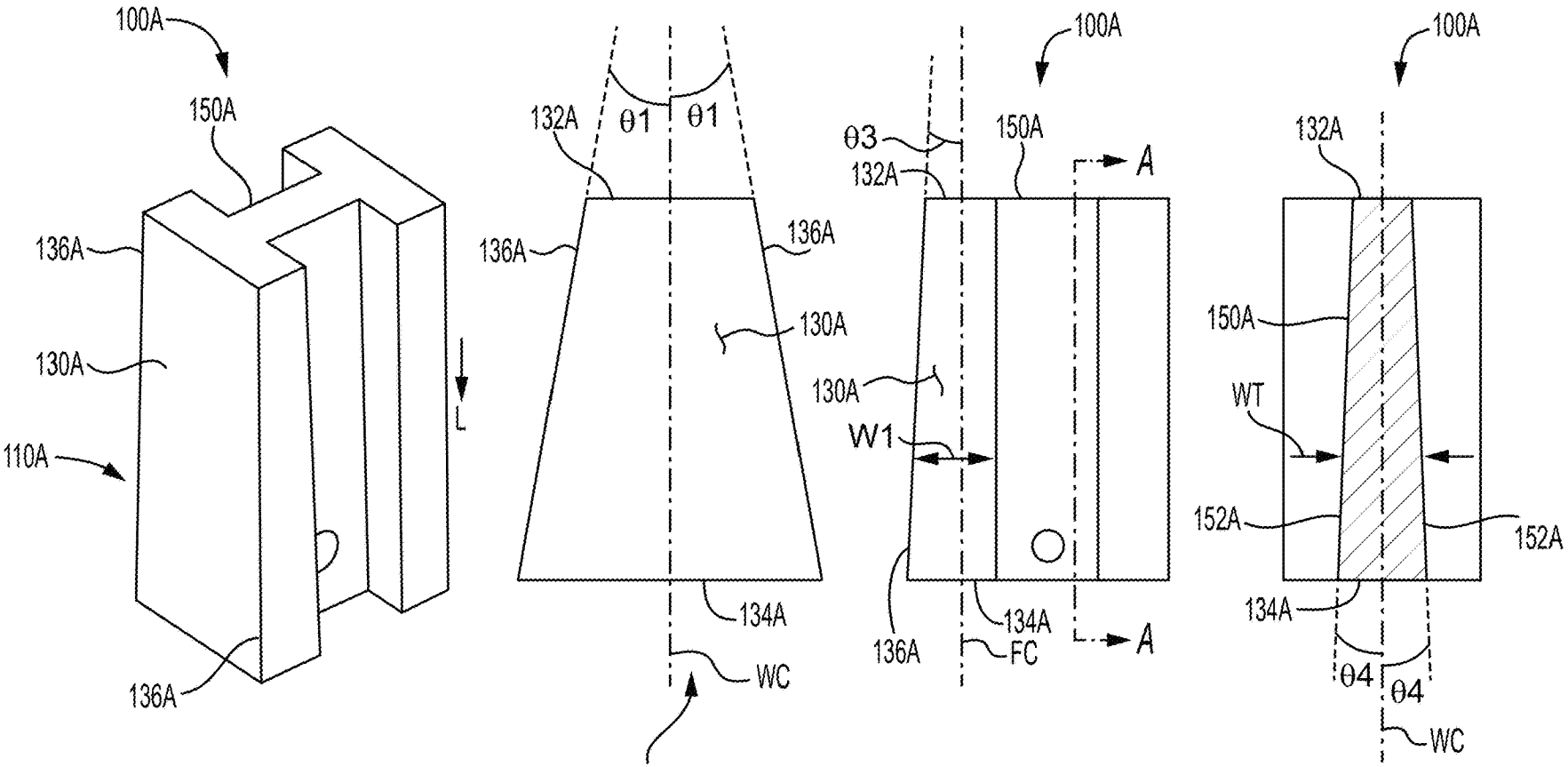
FIG. 7A is a perspective view illustrating a first connecting component of an assembly of parts according to an exemplary embodiment of the present disclosure.
FIG. 7B is a first side view illustrating the first connecting component of FIG. 7A.
FIG. 7C is a second side view illustrating the first connecting component of FIG. 7A.
FIG. 7D is a cross-sectional view taken along line A-A of FIG. 7C.

Referring to FIG. 7B, a peripheral edge 136A of a flange 130A of an elongated protrusion 110A tapers with an angle Θ1 ranging from about 2 degrees to about 5 degrees relative to a width centerline WC of a flange 130A of the elongated protrusion 110A. The width centerline WC extends along the flange length L. See FIG. 7B. Therefore, a width of the flange 130A increases in a direction toward a second end 134A of the flange 130A, when starting from a first end 132A of the flange 130A.

Referring to FIG. 7C, a thickness W1 of the flange 130A of the elongated protrusion 110A increases along the flange length L in a direction toward the second end 134A of the flange 130A, when starting from the first end 132A of the flange 130A.

Referring to FIG. 7C, the peripheral edge 136A of the flange 130 tapers with an angle Θ3 that ranges from about 2 degrees to about 5 degrees relative to a thickness centerline FC of the flange 130A. When the first connecting component 100A is oriented vertically, as illustrated in FIGS. 7B, 7C and 7D, the thickness centerline FC, which the angle Θ3 is measured from, is a vertical line passing through the middle of the top thickness of the flange 130A in FIG. 7C. The thickness centerline FC extends along the flange length, as illustrated in FIG. 7C.

Referring to FIG. 7D, a web 150A of the elongated protrusion 110A has a first end 132A, a second end 134A, and a web length extending in the length direction L of the elongated protrusion 110A. The web length is delimited by the first and second ends 132A, 134A of the web 150A. Referring to FIG. 7D, a thickness WT of the web 150A of the elongated protrusion 110A increases along the web length in a direction toward the second end 134A of the web 150A. For example, a peripheral edge 152A of the web 150 tapers with an angle Θ4 ranging from about 2 degrees to about 5 degrees relative to a thickness centerline WC of the web 150A. The thickness centerline WC of the web 150A extends along the web length.

Figure 8A:
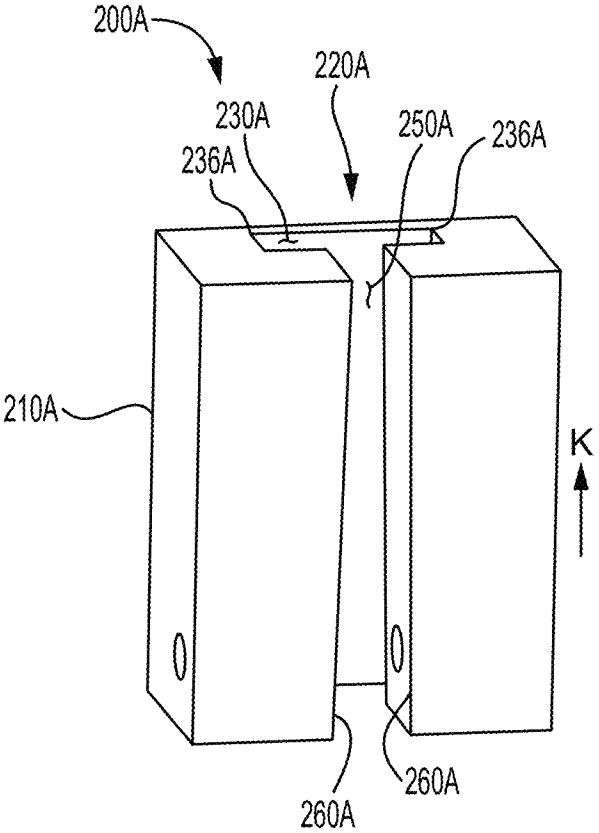
FIG. 8A is a perspective view illustrating a second connecting component of the assembly of parts of FIG. 7A.
Figure 8B:
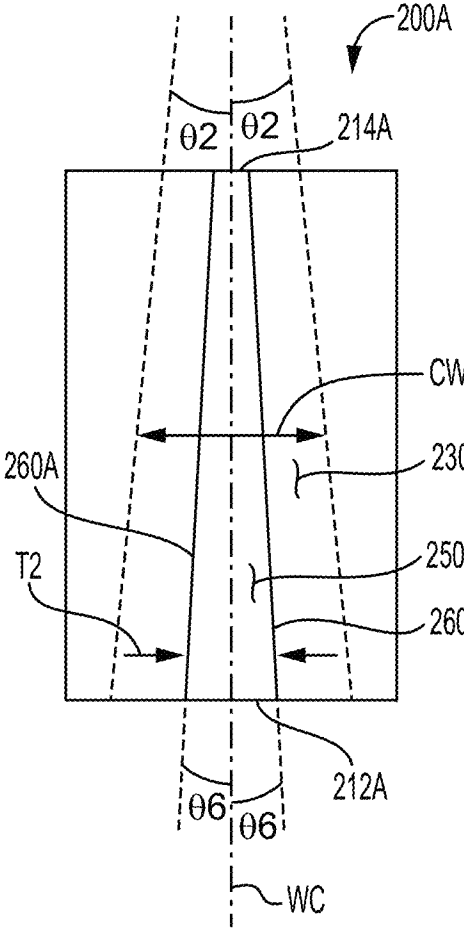
FIG. 8B is a first side view illustrating the second connecting component of FIG. 8A.

Referring to FIG. 8B, a width CW of a first cavity portion 230A decreases along a first cavity length toward a second end 214A of the first cavity portion 230A, when starting from a first end 212A of the first cavity portion 230. The tapering of the first cavity portion 230A caused by the changing width CW is delineated by angle Θ2 on FIG. 8B. The angle Θ2 on FIG. 8B ranges from about 2 degrees to about 5 degrees.

Figure 8C:
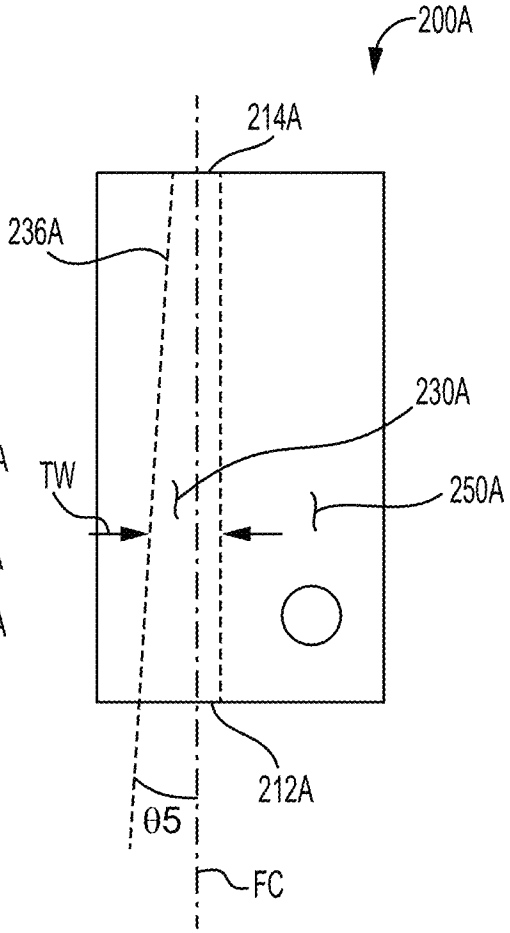
FIG. 8C is a second side view illustrating the second connecting component of FIG. 8A.

Referring to FIG. 8C, a thickness TW of the first cavity portion 230A decreases along the first cavity length toward the second end 214A of the first cavity portion 230A, when starting from the first end 212A of the first cavity portion 230.

Referring to FIG. 8C, a peripheral edge 236A of the first cavity portion 230A tapers at an angle Θ5 that ranges from about 2 degrees to about 5 degrees relative to a thickness centerline FC of the first cavity portion 230A. When the second connecting component 200A is oriented vertically, as illustrated in FIGS. 8B and 8C, the thickness centerline FC of the first cavity portion 230A, from which the angle Θ5 in FIG. 8C is measured from, is a vertical line passing through the middle of the top width of the first cavity portion 230A. The thickness centerline FC of FIG. 8C extends along the first cavity length.

Referring to FIGS. 8A-8C, the second cavity portion 250A has a first end 212A, a second end 214A, and a second cavity length extending in the length direction K of a body 210A of the second connecting component 200A. The second cavity length is delimited by the first and second ends 212A, 214A of the second cavity portion 250.

The first end 212A of the second cavity portion 250A is configured to provide access to the second cavity portion 250A such that the web 150A of the elongated protrusion 110A can be moved inside of the second cavity portion 250A, through the first end 212A of the second cavity portion 250, with the first end 132A of the web 150A entering the first end 212A of the second cavity portion 205A first.

Referring to FIG. 8B, a thickness T2 of the second cavity portion 250 decreases along the second cavity length toward the second end 214A of the second cavity portion 250A. A peripheral edge 260A of the second cavity portion 250A tapers with an angle Θ6 ranging from about 2 degrees to about 5 degrees relative to a thickness centerline WC of the second cavity portion 250. The thickness centerline WC of the second cavity portion 250A extending along the second cavity length. The thickness centerline WC of the second cavity portion 250A, as illustrated in FIG. 8B, is the same as a thickness centerline WC of the first cavity portion 230A.

While the embodiment of FIGS. 7A-8C is described to illustrate that all of the flange thickness, flange width and web width can be tapered (and that the corresponding first cavity width, the first cavity thickness and the second cavity thickness can be tapered to match the flange and web), the present disclosure does not necessarily require all of said features to be tapered.

For example, at least one selected from the group consisting of the web thickness, the flange width and the flange thickness can be tapered in the length direction of the elongated protrusion. In this case, at least one selected from the group consisting of the first cavity portion and the second cavity portion can taper in the length direction of the body of the second connecting component in a way that the tapering of the at least one selected from the group consisting of the web thickness, the flange width and the flange thickness matches the tapering of the at least one selected from the group consisting of the first cavity portion and the second cavity portion.

This configuration produces a strong moment connection between a beam and a column in a metallic building frame.

A steel structural frame of a building can be constructed by connecting sets of the assembly(ies) of parts as disclosed in this specification to steel columns and steel beams of the building's frame. For example, an assembly of parts as disclosed in this specification, which includes the first and second connecting components 100, 200 can be connected to each beam and column of a building's frame to provide a moment connection between the beam(s) and column(s).

Alternatively, the assembly of parts including the first and second connecting components 100A, 200A can be connected to each beam and column of a building's frame to provide a moment connection between the beam(s) and column(s). Moreover, in the same steel framed building, the assembly of parts including the first and second connecting components 100, 200, can be used to connect at least one steel beam end to its respective steel column, and the assembly of parts including the first and second connecting components 100A, 200A can be used to connect at least one other steel beam end to its respective column. Therefore, the steel frame of a building can include a plurality of beams and columns connected to one another by using the sets of the assembly(ies) of parts as disclosed in this specification.

The first and second connecting components 100, 200 (and/or 100A, 200A) can be welded to the first and second structural frame members 300, 400. The first and second connecting components 100, 200 (and/or 100A, 200A) can be welded to the first and second structural frame members 300, 400 in a steel shop, as opposed to at the steel erection site. This configuration reduces the total cost of erecting the steel frame of a building because welding in a steel shop is considerably less expensive (per linear foot) than welding at the erection site.

In addition, the configuration of the first and second connecting components 100, 200 (and/or 100A, 200A) reduces the cost of erecting the steel frame of a building by eliminating all but one of the bolts that must be fit and tightened to specification at the erection site for each moment connection, as it is done for conventional moment connections. In other words, the configuration of the first and second connecting components 100, 200 (and/or 100A, 200A) virtually eliminates the time and effort that a construction crew must spend in the steel erection site to install bolt(s) for the moment connection(s) of the frame.

This configuration reduces the time and cost of erecting the steel frame of a building.

While the present disclosure has been particularly shown and described with reference to exemplary embodiments thereof, it will be apparent to those of ordinary skill in the art that various changes in form and detail may be made therein without departing from the spirit and scope of the present disclosure as defined by the following claims.

What is claimed is:

1. An assembly of parts for a structural moment connection, the assembly comprising:

a first connecting component configured to be connected to a first structural frame member; and a second connecting component configured to be connected to a second structural frame member, wherein the first connecting component includes an elongated protrusion, wherein the second connecting component includes a body having an elongated cavity extending inside of the body from a side surface of the body, wherein the elongated protrusion is configured to be received in the elongated cavity such that the first connecting component and the second connecting component produce a moment connection between the first structural frame member and the second structural frame member when the elongated protrusion is received in the elongated cavity, wherein the elongated protrusion includes a web and a flange connected to one another, the web and the flange extending in a length direction of the elongated protrusion, wherein the elongated cavity includes a first cavity portion and a second cavity portion, wherein the first and second cavity portions are in fluid communication with one another and extend in a length direction of the body of the second connecting component, wherein the flange of the elongated protrusion is configured to be received in the first cavity portion, and the web of the elongated protrusion is configured to be received in the second cavity portion, wherein the flange of the elongated protrusion has a first end, a second end, and a flange length extending in the length direction of the elongated protrusion, the flange length being delimited by the first and second ends of the flange, wherein the first end of the flange is configured to enter the first cavity portion first, wherein the first cavity portion has a first end, a second end, and a first cavity length extending in the length direction of the body of the second connecting component, the first cavity length being delimited by the first and second ends of the first cavity portion, wherein the first end of the first cavity portion is configured to provide access to the first cavity portion such that the flange of the elongated protrusion can be moved inside of the first cavity portion, through the first end of the first cavity portion, with the first end of the flange entering the first end of the first cavity portion first, wherein a width of the flange of the elongated protrusion increases along the flange length in a direction toward the second end of the flange, wherein a width of the first cavity portion decreases along the first cavity length toward the second end of the first cavity portion, and wherein a thickness of the first cavity portion decreases along the first cavity length toward the second end of the first cavity portion.

2. The assembly of claim 1, wherein the flange of the elongated protrusion has a variable width along the length direction of the elongated protrusion, and wherein the first cavity portion has a variable width along the length direction of the body of the second connecting component, and wherein the variable width of the flange of the elongated protrusion matches variable width of the first cavity portion.

3. The assembly of claim 1, wherein the flange of the elongated protrusion has a first flange width proximate to the first end thereof and a second flange width proximate to the second end thereof, the first flange width being smaller than the second flange width, wherein the first cavity portion has a first width proximate to the first end thereof and a second width proximate to the second end thereof, the first width of the first cavity portion being greater than the second width of the first cavity portion.

4. The assembly of claim 1, wherein a peripheral edge of the flange tapers from about 2 degrees to about 5 degrees relative to a width centerline of the flange, the width centerline extending along the flange length.

5. The assembly of claim 1, wherein a peripheral edge of the first cavity portion tapers from about 2 degrees to about 5 degrees relative to a width centerline of the first cavity portion, the width centerline of the first cavity portion extending along the first cavity length.

6. The assembly of claim 1, wherein a thickness of the flange of the elongated protrusion increases along the flange length in a direction toward the second end of the flange.

7. The assembly of claim 1, wherein a peripheral edge of the flange tapers from about 2 degrees to about 5 degrees relative to a thickness centerline of the flange, the thickness centerline extending along the flange length, or a peripheral edge of the first cavity portion tapers from about 2 degrees to about 5 degrees relative to a thickness centerline of the first cavity portion, the thickness centerline of the first cavity portion extending along the first cavity length.

8. The assembly of claim 1, wherein the web of the elongated protrusion has a first end, a second end, and a web length extending in the length direction of the elongated protrusion, the web length being delimited by the first and second ends of the web, wherein the first end of the web is configured to enter the second cavity portion, wherein the second cavity portion has a first end, a second end, and a second cavity length extending in the length direction of the body of the second connecting component, the second cavity length being delimited by the first and second ends of the second cavity portion, wherein the first end of the second cavity portion is configured to provide access to the second cavity portion such that the web of the elongated protrusion can be moved inside of the second cavity portion, through the first end of the second cavity portion, with the first end of the web entering the first end of the second cavity portion first.

9. The assembly of claim 8, wherein a thickness of the web of the elongated protrusion increases along the web length in a direction toward the second end of the web.

10. The assembly of claim 9, wherein a peripheral edge of the web tapers from about 2 degrees to about 5 degrees relative to a thickness centerline of the web, the thickness centerline of the web extending along the web length.

11. An assembly of parts for a structural moment connection, the assembly comprising:

a first connecting component configured to be connected to a first structural frame member; and a second connecting component configured to be connected to a second structural frame member, wherein the first connecting component includes an elongated protrusion, wherein the second connecting component includes a body having an elongated cavity extending inside of the body from a side surface of the body, wherein the elongated protrusion is configured to be received in the elongated cavity such that the first connecting component and the second connecting component produce a moment connection between the first structural frame member and the second structural frame member when the elongated protrusion is received in the elongated cavity, wherein the elongated protrusion includes a web and a flange connected to one another, the web and the flange extending in a length direction of the elongated protrusion, wherein the elongated cavity includes a first cavity portion and a second cavity portion, wherein the first and second cavity portions are in fluid communication with one another and extend in a length direction of the body of the second connecting component, wherein the flange of the elongated protrusion is configured to be received in the first cavity portion, and the web of the elongated protrusion is configured to be received in the second cavity portion, wherein the flange of the elongated protrusion has a first end, a second end, and a flange length extending in the length direction of the elongated protrusion, the flange length being delimited by the first and second ends of the flange, wherein the first end of the flange is configured to enter the first cavity portion first, wherein the first cavity portion has a first end, a second end, and a first cavity length extending in the length direction of the body of the second connecting component, the first cavity length being delimited by the first and second ends of the first cavity portion, wherein the first end of the first cavity portion is configured to provide access to the first cavity portion such that the flange of the elongated protrusion can be moved inside of the first cavity portion, through the first end of the first cavity portion, with the first end of the flange entering the first end of the first cavity portion first, wherein a width of the flange of the elongated protrusion increases along the flange length in a direction toward the second end of the flange, wherein a width of the first cavity portion decreases along the first cavity length toward the second end of the first cavity portion, wherein a thickness of the first cavity portion decreases along the first cavity length toward the second end of the first cavity portion, and wherein a thickness of the second cavity portion decreases along the second cavity length toward the second end of the second cavity portion.

12. The assembly of claim 1, wherein the elongated protrusion includes a first through hole extending in the web thereof in a direction that crosses the length direction of the elongated protrusion, wherein the body of the second connecting component includes a second through hole, said second through hole extending in a direction that crosses the length direction of the body of the second connecting component, and wherein the first and second through holes are configured to line up with one another when the elongated protrusion is received in the elongated cavity such that a bolt can be selectively extended therethrough to prevent the first and second connecting components from being disconnected from one another.

13. The assembly of claim 1, further comprising a metal plate, wherein the first and second connecting components are made of a metal, and wherein the metal plate is welded to the first and second connecting components.

14. An assembly of parts for a structural moment connection, the assembly comprising:

a first connecting component configured to be connected to a first structural frame member; and a second connecting component configured to be connected to a second structural frame member, wherein the first connecting component includes an elongated protrusion, wherein the second connecting component includes a body having an elongated cavity extending inside of the body from a side surface of the body, wherein the elongated protrusion is configured to be received in the elongated cavity such that the first connecting component and the second connecting component produce a moment connection between the first structural frame member and the second structural frame member when the elongated protrusion is received in the elongated cavity, wherein the elongated protrusion includes a web and a flange connected to one another, the web and the flange extending in a length direction of the elongated protrusion, wherein the elongated cavity includes a first cavity portion and a second cavity portion, wherein the first and second cavity portions are in fluid communication with one another and extend in a length direction of the body of the second connecting component, wherein the flange of the elongated protrusion is configured to be received in the first cavity portion, and the web of the elongated protrusion is configured to be received in the second cavity portion, wherein the web of the elongated protrusion has a first end, a second end, and a web length extending in the length direction of the elongated protrusion, the web length being delimited by the first and second ends of the web, wherein the first end of the web is configured to enter the second cavity portion, wherein the second cavity portion has a first end, a second end, and a second cavity length extending in the length direction of the body of the second connecting component, the second cavity length being delimited by the first and second ends of the second cavity portion, wherein the first end of the second cavity portion is configured to provide access to the second cavity portion such that the web of the elongated protrusion can be moved inside of the second cavity portion, through the first end of the second cavity portion, with the first end of the web entering the first end of the second cavity portion first, and wherein a thickness of the web of the elongated protrusion increases along the web length in a direction toward the second end of the web.

15. The assembly of claim 11, wherein a peripheral edge of the second cavity portion tapers from about 2 degrees to about 5 degrees relative to a thickness centerline of the second cavity portion, the thickness centerline of the second cavity portion extending along the second cavity length.

* * * * *